US005643004A

United States Patent [19]

Otto et al.

[11] Patent Number: 5,643,004

[45] Date of Patent: Jul. 1, 1997

[54] ELECTRIC CONNECTION CONTACT IN A SINGLE PIECE

[75] Inventors: Hans-Dieter Otto, Wipperfürth; Thomas Wabnitz, Solingen; Ralf Korte, Wuppertal, all of Germany

[73] Assignee: Quante Aktiengesellschaft, Wuppertal, Germany

[21] Appl. No.: 698,223

[22] Filed: Aug. 14, 1996

Related U.S. Application Data

[63] Continuation of Ser. No. 256,573, filed as PCT/EP93/02336, Aug. 30, 1993, abandoned.

[30] Foreign Application Priority Data

Sep. 4, 1992 [DE] Germany ..... 9211917 U

[51] Int. Cl.[6] ..... H01R 4/24

[52] U.S. Cl. ..... 439/397

[58] Field of Search ..... 439/395–400, 439/856, 857

[56] References Cited

U.S. PATENT DOCUMENTS

| | | | |
|---|---|---|---|
| 4,553,808 | 11/1985 | Weidler et al. | 439/395 |
| 5,030,132 | 7/1991 | Hayes | 439/397 |
| 5,030,143 | 7/1991 | Hatagishi | 439/395 |
| 5,041,006 | 8/1991 | Van Zanten et al. | 439/397 |
| 5,118,305 | 6/1992 | Hell | 439/396 |
| 5,163,855 | 11/1992 | Gerke et al. | 439/395 |
| 5,427,545 | 6/1995 | Kourimsky et al. | 439/397 |

FOREIGN PATENT DOCUMENTS

| | | | |
|---|---|---|---|
| 0308635 | 3/1989 | European Pat. Off. . | |
| 3137429 | 4/1983 | Germany . | |
| 3841083 | 2/1990 | Germany | 439/395 |
| 4300347 | 7/1994 | Germany | 439/395 |
| 641294 | 2/1984 | Switzerland . | |
| 2078450 | 1/1982 | United Kingdom . | |
| 2130820 | 6/1984 | United Kingdom . | |

*Primary Examiner*—Neil Abrams
*Assistant Examiner*—Brian J. Biggi
*Attorney, Agent, or Firm*—Sughrue, Mion, Zinn, Macpeak & Seas

[57] ABSTRACT

A connection contact in a single piece has two insulation displacement contacts (14) having each an insulation displacement slot (16), a contact and guiding surface (20) and a shearing element. The connection contact further has two contact legs (22, 23) one end of which is connected to an insulation displacement contact (14), a home contact formed between the free ends of the contact legs and a section (27) that links the insulation displacement contacts (14). The disclosed connection contact in a single piece is characterized in that the linking section (27) is designed as a substantially U-shaped loop (28). As lead-shearing element, an insulation displacement contact (14) is associated to each leg (30) of the U- or V-shaped loop (28), so that the contact pressure between the contact legs of the home contact can be easily adjusted as desired. A fatigue-proof home contact is thus obtained, which is also economical to produce.

5 Claims, 2 Drawing Sheets

ELECTRIC CONNECTION CONTACT IN A SINGLE PIECE

This is a continuation of application Ser. No. 08/256,573, filed as PCT/EP93/02336, Aug. 30, 1993, now abandoned.

BACKGROUND OF THE INVENTION

The present invention relates to a connection contact in a single piece according to the preamble of claim 1 with two symmetrically arranged insulation displacement contacts.

Such a connection contact is known from EP-A2-0 344 526 (FIG. 10). The symmetrically arranged and similarly formed insulation displacement contacts of this known connection contact each have an insulation displacement slot, a contact and guiding surface and a shearing element. Additionally, the connection contact has two contact legs which are connected with one of their ends to one of the two insulation displacement contacts, a home contact being formed between the free ends of the contact legs. Both insulation displacement contacts are connected with each other by a linking section and thus form the connection contact in a single piece. In this known connection contact, the lead which is neither bared nor cut to length is pressed with a one-armed wiring tool, for example a screwdriver, into the insulation displacement slot. During this insertion, the lead insulation is partially severed in one operating step, the lead is contacted and the projecting lead end is cut off at the shearing element.

The home contact formed between the contact legs makes possible the insertion of a test or measuring connector by means of which the leads are examined. Additionally, protective devices can be inserted into the home contact.

In the known connection contact, the shearing elements are formed by two bent shearing strips. Further, the section linking both insulation displacement contacts consists of a flat wall section. The contact pressure between the contact legs of the home contact is formed by an asymmetrical stamping of both contact legs.

SUMMARY OF THE INVENTION

It is the object underlying the present invention to further develop a connection contact in a single piece of the type initially mentioned in such a manner that with economical production a constant contact pressure of a predetermined amount between the legs of the home contact can be set in a simple manner.

This underlying problem is solved by a connection contact of the type initially mentioned in that the linking section is an essentially U-or V-shaped loop, respectfully one leg of the loop serving as shearing-element for a lead after an insulation displacement contact.

On account of the inventive design of the linking section in the form of a loop of predetermined width, the contact pressure between the contact legs of the home contact can be desirably adjusted in a simple manner. Thus, a fatigue-free home contact is provided, the contact force of which always remains continuously constant even in the case of repeated use. Finally, the inventive connection contact can be extremely economically produced, since, in comparison to the state of the art, a separate forming of the shearing element no longer applies because the upper end faces of the legs of the loop are used as shearing elements. The selected width of the loop serves on the one hand to adjust the contact force between the contact legs and simultaneously acts as a shearing element.

Advantageous embodiments of the invention are defined in the dependent claims. Thus, the loop can be at least partially sharp-edged, which simplifies the shearing of the lead to be contacted. Furthermore, at least one contact leg of the home contact can be designed with a contacting corrugation by means of which a high contact pressure is effected at a defined location.

BRIEF DESCRIPTION OF THE DRAWINGS

The invention is described in the following by way of an exemplified embodiment with reference to the enclosed drawings, in which.

DETAILED DESCRIPTION OF THE INVENTION

Figure 1:
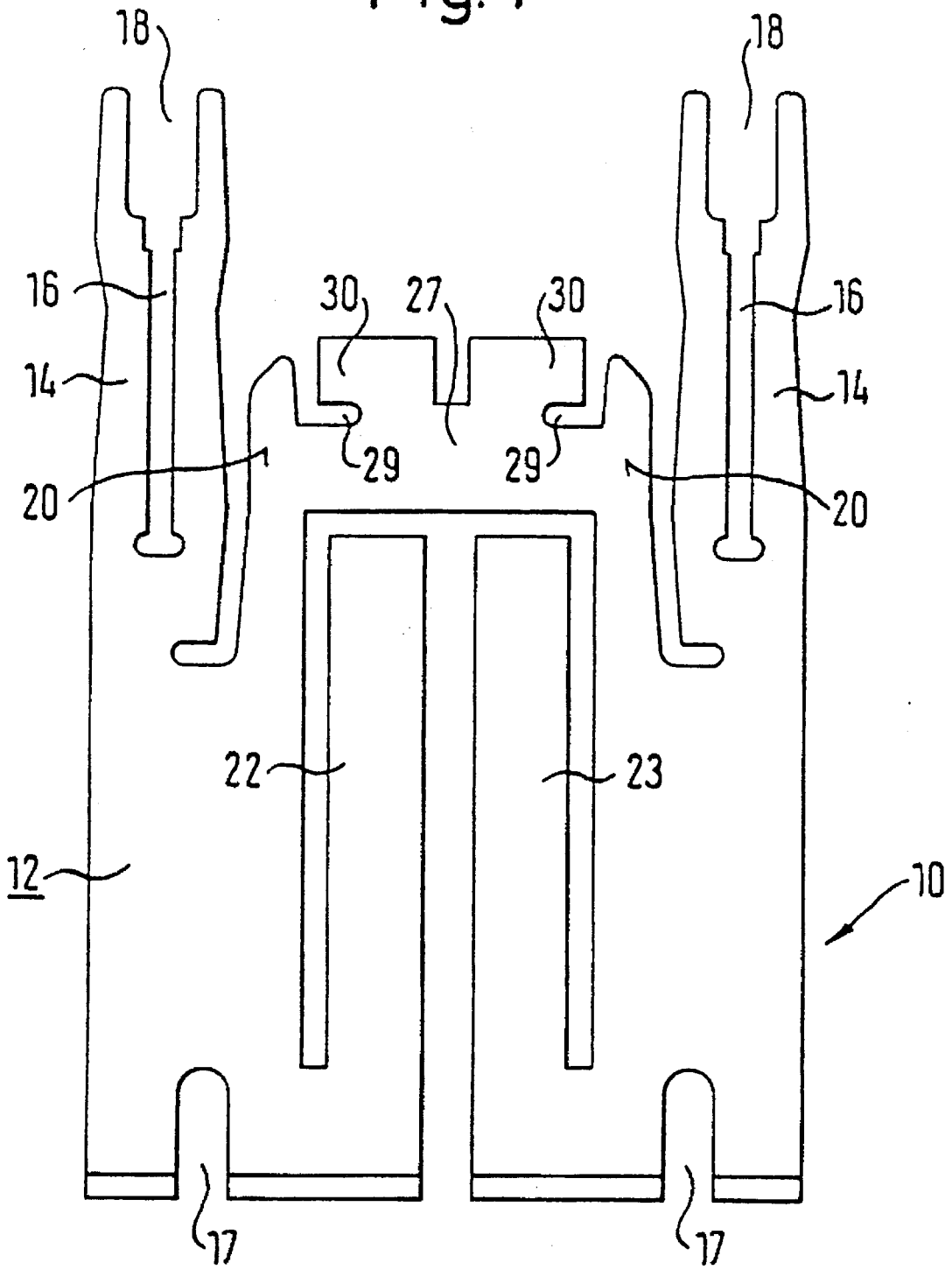
FIG. 1 shows a plan view of a pre-stamped connection contact which is not bent.
Figure 3A:
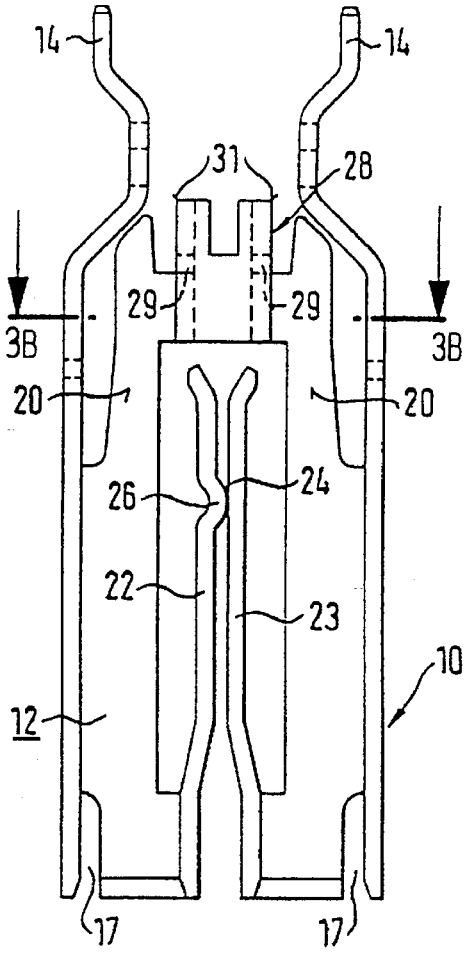
FIG. 3A shows a side view of the completely bent connection contact of FIG. 2.
Figure 3B:
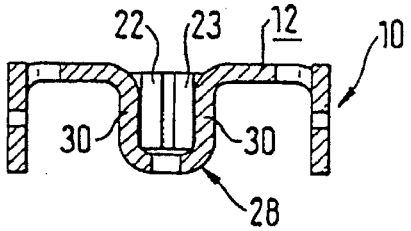
FIG. 3B shows a sectional view along the line A—A in FIG. 3.

FIG. 3A shows a connection contact 10 in a single piece which consists of a main part 12 with which two extended parts are connected as insulation displacement contacts 14. An insulation displacement slot 16 is formed in the contacts which has an introduction opening 18 (FIG. 1). The main part 12 has two contact and guiding surfaces 20 which are angled at a right angle to the insulation displacement contacts 14.

Two contact layers 22, 23 are connected with their one (lower) end to the main part 12 and also angled at a right angle to the main part. A home contact 24 is formed in the vicinity of the free ends of the legs between the contact legs, the leg 22 having a contact corrugation 26.

The section 27 linking both symmetrically formed and arranged insulation displacement contacts 14 is designed to have the form of a substantially U-shaped loop 28 which is also connected in a single piece with the main part 12. Respectively one leg 20 of the U-shaped loop serves in this case as a lead-shearing element arranged after the extended part with the insulation displacement slot 16. Here, the edges 31 of the legs 30 of the loop 28 are sharp-edged to make shearing of the lead to be contacted easier. For reasons of production technology, the linking section 27 which forms the loop 28 is provided with two notches 29.

With reference to FIGS. 1 to 3A, the production of the inventive connection contact is described in the following. In a first production step, the contact piece forming the connection contact is pre-stamped from flat metal in a follow-on tool and receives the shape shown in FIG. 1, the still flat contact piece subsequently being silver-plated. As FIG. 1 shows, the insulation displacement slot 16, both contact layers 22, 23 and the contact and guiding surfaces 20 are already formed. Additionally, two U-shaped recesses 17 are provided at the lower side of the contact piece which simplify the bending of the insulation displacement contacts 14. The notches 29 in the linking but not yet loop-shaped bent section 27 are also already formed.

Figure 2:
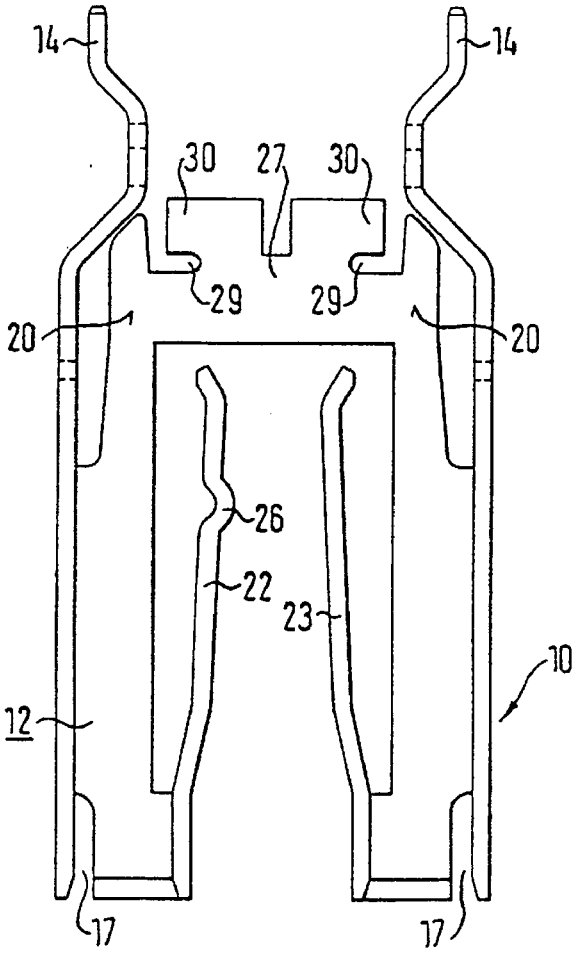
FIG. 2 shows the partially pre-bent connection contact of FIG. 1.

In a second manufacturing step, the silver-plated contact piece is pre-bent, as shown in FIG. 2. Following this step, both the contact legs 22, 23 and the extension parts serving as the insulation displacement contacts 14 are bent at a right angle to the main part 12.

By bending the linking section 27 into a loop 28, the connection contact in a single piece is finished in a last step, the width of the loop 28 and the contacting force between the contact legs 22, 23 of the home contact being adjustable by varyingly strong bending. In this case, the contact legs are pressed to a greater or lesser extent towards one another. A measuring and testing connector, by means of which measurements can be carried out in the lead which has been connected to the insulation displacement contacts, can be introduced into the home contact 24 formed in this way. Additionally, overvoltage protection devices can be inserted into the home contact and contacted.

Should a testing of the connected leads be desired in both directions, i.e. if both leads connected to the insulation displacement contacts 14 are to be examined separately, this can be achieved as follows. After forming the loop 28 of the connection contact, this is stamped through in a shell in a region of the loop 28, on account of which two electrically separate contact halves are provided. The shell simultaneously serves in this case as a guiding device for the assembly of an insulating material body into which both contact halves are inserted. In this manner, it is ensured that despite separation, i.e. complete stamping through of the loop, the previously set pre-tensioning force is maintained between the contact legs.

What is claimed is:

1. Connection contact in a single piece with two insulation displacement contacts (14) respectively comprising an insulation contact slot (16), a contact and guiding surface (20), and a shearing element, said connection contact comprising two contact legs (22,23) connected at one of their ends with respectively one insulation displacement contact (14), a home contact (24) formed between the free ends of the contact legs, and a section (27) linking the insulation displacement contacts (14), characterized in that the linking section (27) is designed in the form of a substantially U-shaped or V-shaped loop (28), said loop being at least partially sharp-edged, respectively one leg (30) of the U- or V-shaped loop (28) being arranged as a lead-shearing element after an insulation displacement contact (14).

2. Connection contact according to claim 1, characterized in that this is of a single piece and consists of a main part (12) with respect to which the contact legs (22,23) and the insulation displacement contacts (14) are angled at a right angle.

3. Connection contact according to claim 1, characterized in that the main part (12) is provided with two notches (17) which simplify the bending of the insulation displacement contacts (14).

4. Connection contact according to claim 1, characterized in that at least one contact leg (22) is formed with a contact corrugation (26).

5. Connection contact according to claim 1, characterized in that the linking section (27) is provided with two notches (29).

* * * * *